US008474535B2

(12) United States Patent
Richards et al.

(10) Patent No.: US 8,474,535 B2
(45) Date of Patent: Jul. 2, 2013

(54) WELL SCREEN INFLOW CONTROL DEVICE WITH CHECK VALVE FLOW CONTROLS

(75) Inventors: William M. Richards, Frisco, TX (US); John C. Gano, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 226 days.

(21) Appl. No.: 11/958,466

(22) Filed: Dec. 18, 2007

(65) Prior Publication Data

US 2009/0151925 A1 Jun. 18, 2009

(51) Int. Cl.
*E21B 34/08* (2006.01)

(52) U.S. Cl.
USPC ..... 166/325; 166/319; 166/324; 166/227

(58) Field of Classification Search
USPC ..... 166/319, 321, 324, 325, 227
See application file for complete search history.

(56) References Cited

U.S. PATENT DOCUMENTS

| | | | | |
|---|---|---|---|---|
| 148,387 | A | 3/1874 | Squires | |
| 1,536,348 | A | 5/1925 | Mack | |
| 2,602,516 | A | 7/1952 | Gray | |
| 2,809,654 | A | 10/1957 | Kraft | |
| 2,945,541 | A | 7/1960 | Maly | |
| 3,845,818 | A | 11/1974 | Deaton | |
| 4,307,204 | A | 12/1981 | Vidal | |
| 4,813,218 | A | 3/1989 | Claesson | |
| 5,273,066 | A | 12/1993 | Graham | |
| 5,337,808 | A | 8/1994 | Graham | |
| 5,906,238 | A | 5/1999 | Carmody et al. | |
| 6,015,011 | A | 1/2000 | Hunter | |
| 6,227,299 | B1 | 5/2001 | Dennistoun | |
| 6,343,651 | B1 | 2/2002 | Bixenman | |
| 6,354,378 | B1 * | 3/2002 | Patel | 166/374 |
| 6,371,210 | B1 * | 4/2002 | Bode et al. | 166/370 |
| 6,390,199 | B1 * | 5/2002 | Heijnen | 166/319 |
| 6,505,682 | B2 | 1/2003 | Brockman | |
| 6,622,794 | B2 | 9/2003 | Zisk, Jr. | |
| 6,644,412 | B2 | 11/2003 | Bode | |
| 6,883,613 | B2 | 4/2005 | Bode | |

(Continued)

FOREIGN PATENT DOCUMENTS

| | | | |
|---|---|---|---|
| WO | 02059452 | A1 | 8/2002 |
| WO | 02090714 | A1 | 11/2002 |

(Continued)

OTHER PUBLICATIONS http://en.wikipedia.org/wiki/Drag_(physics); date: Jul. 25, 2006.*

(Continued)

*Primary Examiner* — Sean Andrish
(74) *Attorney, Agent, or Firm* — Smith IP Services, P.C.

(57) ABSTRACT

A well screen inflow control device with check valve flow controls. A well screen assembly includes a filter portion and a flow control device which varies a resistance to flow of fluid in response to a change in velocity of the fluid. Another well screen assembly includes a filter portion and a flow resistance device which decreases a resistance to flow of fluid in response to a predetermined stimulus applied from a remote location. Yet another well screen assembly includes a filter portion and a valve including an actuator having a piston which displaces in response to a pressure differential to thereby selectively permit and prevent flow of fluid through the valve.

5 Claims, 14 Drawing Sheets

U.S. PATENT DOCUMENTS

| | | | | |
|---|---|---|---|---|
| 6,957,703 | B2 | 10/2005 | Trott et al. | |
| 7,013,979 | B2 | 3/2006 | Richard | |
| 7,083,162 | B2 | 8/2006 | He | |
| 7,096,945 | B2 | 8/2006 | Richards | |
| 7,185,706 | B2 | 3/2007 | Freyer | |
| 7,191,833 | B2 | 3/2007 | Richards | |
| 7,207,386 | B2 | 4/2007 | Brannon | |
| 7,215,594 | B2 | 5/2007 | Im | |
| 7,252,153 | B2 | 8/2007 | Hejl | |
| 7,290,606 | B2 | 11/2007 | Coronado | |
| 7,296,597 | B1 | 11/2007 | Freyer | |
| 7,367,395 | B2 | 5/2008 | Vidrine | |
| 7,426,962 | B2 | 9/2008 | Moen | |
| 7,537,056 | B2 | 5/2009 | MacDougall | |
| 8,037,940 | B2 * | 10/2011 | Patel et al. | 166/386 |
| 2002/0108755 | A1 | 8/2002 | Zisk | |
| 2004/0055760 | A1 | 3/2004 | Nguyen | |
| 2004/0108107 | A1 | 6/2004 | Wittrisch | |
| 2005/0072576 | A1 | 4/2005 | Henriksen et al. | |
| 2005/0103497 | A1 | 5/2005 | Gondouin | |
| 2006/0027377 | A1 * | 2/2006 | Schoonderbeek et al. | 166/386 |
| 2006/0113089 | A1 * | 6/2006 | Henriksen et al. | 166/386 |
| 2006/0175065 | A1 | 8/2006 | Ross | |
| 2006/0185849 | A1 | 8/2006 | Edwards et al. | |
| 2007/0246210 | A1 | 10/2007 | Richards | |
| 2007/0246212 | A1 | 10/2007 | Richards | |
| 2007/0246213 | A1 | 10/2007 | Hailey, Jr. | |
| 2007/0246225 | A1 | 10/2007 | Hailey, Jr. et al. | |
| 2007/0246407 | A1 | 10/2007 | Richards et al. | |
| 2008/0035330 | A1 | 2/2008 | Richards | |
| 2008/0041580 | A1 | 2/2008 | Freyer | |
| 2008/0041581 | A1 | 2/2008 | Richards | |
| 2008/0041582 | A1 | 2/2008 | Saetre | |
| 2008/0041588 | A1 | 2/2008 | Richards | |
| 2008/0066912 | A1 | 3/2008 | Freyer | |
| 2008/0135255 | A1 | 6/2008 | Coronado | |
| 2008/0264628 | A1 | 10/2008 | Coronado et al. | |
| 2009/0000787 | A1 | 1/2009 | Hill | |
| 2009/0078428 | A1 | 3/2009 | Ali | |
| 2009/0133869 | A1 | 5/2009 | Clem | |
| 2009/0277650 | A1 | 11/2009 | Casciaro et al. | |

FOREIGN PATENT DOCUMENTS

| | | | |
|---|---|---|---|
| WO | 2007126496 | A2 | 11/2007 |
| WO | 2008024645 | A2 | 2/2008 |
| WO | 2008024645 | A3 | 2/2008 |
| WO | 2009048822 | A2 | 4/2009 |
| WO | 2009048823 | A2 | 4/2009 |
| WO | 2009067021 | A2 | 5/2009 |

OTHER PUBLICATIONS

International Search Report and Written Opinion issued for International Application No. PCT/US07/75743 dated Feb. 11, 2008 (8 pages).

Office Action issued for U.S. Appl. No. 11/466,022 dated Feb. 8, 2008 (30 pages).

Office Action dated Jul. 10, 2008, for U.S. Appl. No. 11/668,024 (7 pages).

Office Action dated Aug. 26, 2008, for U.S. Appl. No. 11/466,022 (8 pages).

Search Report and Written Opinion for PCT/US07/66991 dated Aug. 27, 2008.

Office Action issued Oct. 20, 2008, for U.S. Appl. No. 11/409,734, 30 pages.

Office Action issued Dec. 1, 2008, for U.S. Appl. No. 11/407,848, 21 pages.

Office Action issued Dec. 17, 2008, for U.S. Appl. No. 11/407,704, 17 pages.

International Search Report and Written Opinion issued Feb. 19, 2009, for International Patent Application Serial No. PCT/US08/87318, 7 pages.

International Search Report and Written Opinion issued Feb. 27, 2009, for International Patent Application Serial No. PCT/IB07/04287, 6 pages.

International Preliminary Report on Patentability issued Mar. 5, 2009, for International Patent Application Serial No. PCT/US07/75743, 5 pages.

Office Action issued Mar. 16, 2009, for U.S. Appl. No. 11/671,319, 47 pages.

Chinese Office Action issued Feb. 27, 2009, for Chinese Patent Application Serial No. 200580016654.2, 6 pages.

Office Action issued Apr. 1, 2009, for U.S. Appl. No. 11/407,704, 11 pages.

Office Action issued Apr. 14, 2009, for U.S. Appl. No. 11/409,734, 9 pages.

Examiner's Answer issued Jul. 28, 2009, for U.S. Appl. No. 11/407,848, 20 pages.

International Preliminary Report on Patentability issued Aug. 6, 2009, for International Patent Application Serial No. PCT/IB2007/004287, 5 pages.

Office Action issued Oct. 27, 2009, for U.S. Appl. No. 11/407,848, 10 pages.

Office Action issued Nov. 12, 2009, for U.S. Appl. No. 11/409,734, 17 pages.

Examiner's Answer issued Nov. 30, 2009, for U.S. Appl. No. 11/407,704, 22 pages.

Office Action issued for U.S. Appl. No. 11/668,024 dated Jan. 11, 2008 (18 pages).

Office Action issued for U.S. Appl. No. 11/407,704 dated Jan. 14, 2008 (23 pages).

Australian Office Action issued Mar. 31, 2010, for Australian Patent Application Serial No. 2007315792, 1 page.

International Preliminary Report on Patentability issued Jul. 1, 2010, for International Patent Application Serial No. PCT/US08/087346, 8 pages.

Office Action issued Apr. 8, 2011 for Chinese patent application serial No. 200880121811.X, 5 pages.

English translation of Chinese Office Action issued Apr. 8, 2011 for Chinese patent application serial No. 200880121811.X, 7 pages.

Australian Office Action issued Apr. 18, 2011 for AU Patent Application No. 2008338356, 2 pages.

China Office Action issued Apr. 6, 2012 for CN Patent Application No. 200780014027.4, 9 pages.

European Search Report issued Jun. 13, 2012 for EP Patent Application No. 07866607.0, 5 pages.

Chinese Office Action issued Dec. 11, 2012 for Chinese Patent Application No. 200780014027.4, 5 pages.

* cited by examiner

WELL SCREEN INFLOW CONTROL DEVICE WITH CHECK VALVE FLOW CONTROLS

BACKGROUND

The present invention relates generally to equipment utilized and operations performed in conjunction with a subterranean well and, in an embodiment described herein, more particularly provides a well screen inflow control device with check valve flow controls.

It is desirable to exclude, or at least substantially reduce, the production of water from a well intended for hydrocarbon production. For example, it is very desirable for the fluid which is produced from the well to have a relatively high proportion of hydrocarbons, and a relatively low proportion of water. In some cases, it is also desirable to restrict the production of hydrocarbon gas from a well.

In addition, where fluid is produced from a long interval of a formation penetrated by a wellbore, it is known that balancing the production of fluid along the interval can lead to reduced water and gas coning, and more controlled conformance, thereby increasing the proportion and overall quantity of oil produced from the interval. Inflow control devices (ICD's) have been used in conjunction with well screens in the past to restrict flow of produced fluid through the screens for this purpose of balancing production along an interval. For example, in a long horizontal wellbore, fluid flow near a heel of the wellbore may be more restricted as compared to fluid flow near a toe of the wellbore, to thereby balance production along the wellbore.

However, further advancements are needed in the art of reducing production of undesired fluids from hydrocarbon wells, in part due to the difficulties and costs associated with separating the undesired fluids from the desired fluids at the surface and then disposing of the undesired fluids.

SUMMARY

In the present specification, well screen inflow control devices are provided which solve at least one problem in the art. One example is described below in which a velocity check valve is used to reduce production of water. Another example is described below in which fluid loss is prevented. Yet another example is described in which restriction to flow through a well screen assembly can be substantially decreased, if desired.

In one aspect, a well screen assembly is provided which includes a filter portion for filtering fluid and a flow control device which varies a resistance to flow of the fluid in response to a change in velocity of the fluid. The flow control device may increase the resistance to flow as a density of the fluid increases. The flow control device may decrease a flow area in response to an increase in the velocity of the fluid. The flow control device may increase the resistance to flow as the velocity of the fluid increases.

In another aspect, a well screen assembly is provided which includes a filter portion for filtering fluid and a flow resistance device which decreases a resistance to flow of the fluid in response to a predetermined stimulus applied from a remote location. The stimulus may be a pressure variation. The stimulus may be an increase in a pressure differential from an interior to an exterior of the screen assembly.

In yet another aspect, a well screen assembly is provided which includes a filter portion for filtering fluid and a valve including an actuator having a piston which displaces in response to a pressure differential to thereby selectively permit and prevent flow of the fluid through the valve. The well screen assembly may also include a flow restrictor and/or an excluder device which increasingly blocks flow of an undesired portion (such as gas and/or water) of the fluid as the undesired portion increases.

These and other features, advantages, benefits and objects will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings.

Figure 1:
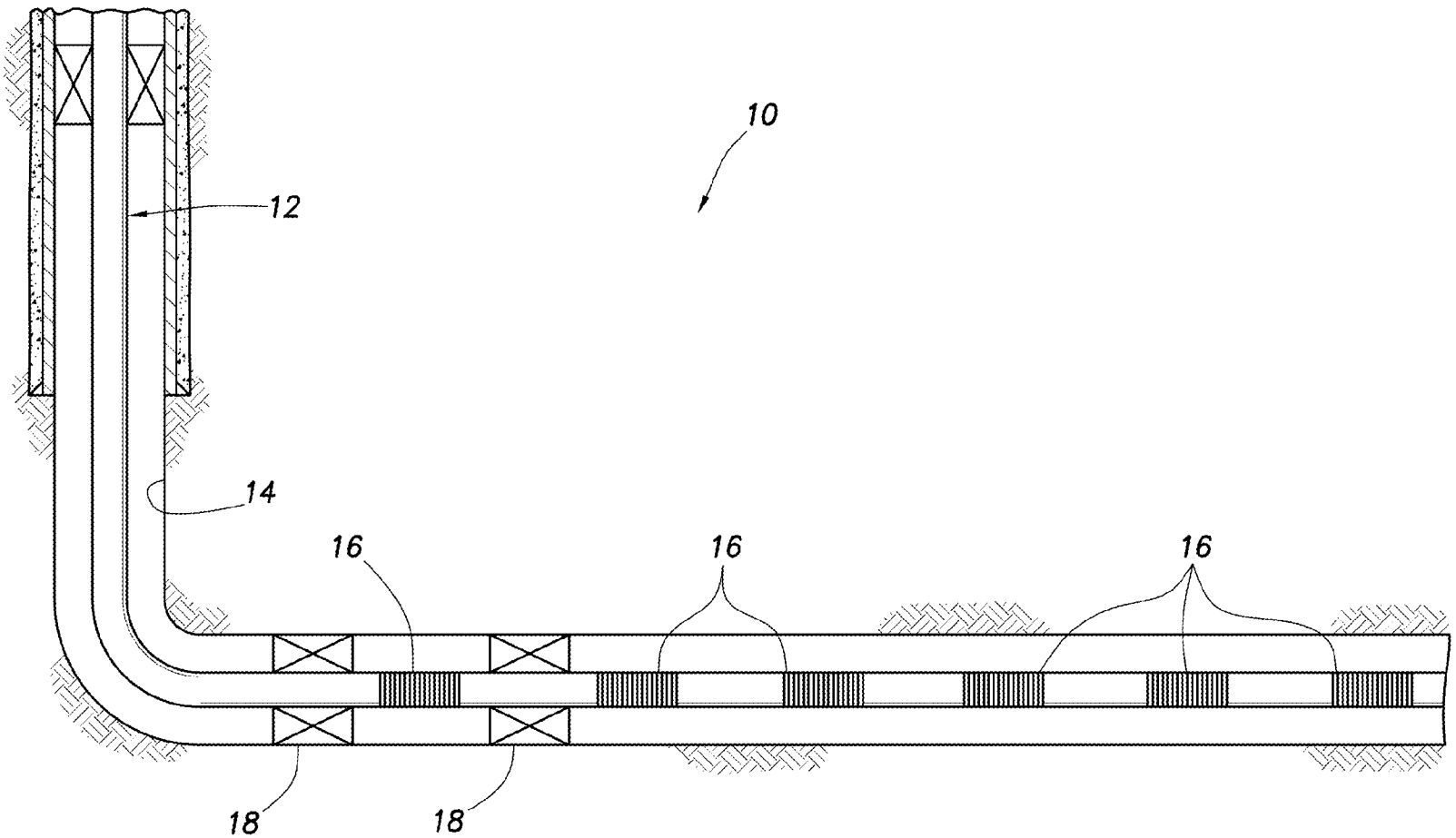
FIG. 1 is a schematic partially cross-sectional view of a well system embodying principles of the present invention.

Representatively illustrated in FIG. 1 is a well system 10 which embodies principles of the present invention. A tubular string 12, such as a production tubing string, is installed in a wellbore 14 having a substantially horizontal section. Multiple well screen assemblies 16 are interconnected in the tubular string 12 and positioned in the horizontal section of the wellbore 14.

The wellbore 14 is depicted in FIG. 1 as being uncased or open hole in the horizontal section. Packers 18 may be used between various ones of the screen assemblies 16 if desired, for example, to isolate different zones or intervals along the wellbore 14 from each other.

Note that it is not necessary in keeping with the principles of the invention for screen assemblies to be positioned in a horizontal wellbore portion, for the wellbore to be uncased, for packers to be used between screen assemblies, or for any of the other details of the well system 10 to exist. The well system 10 is just one example of many different uses for the inventive concepts described herein.

Figure 2:
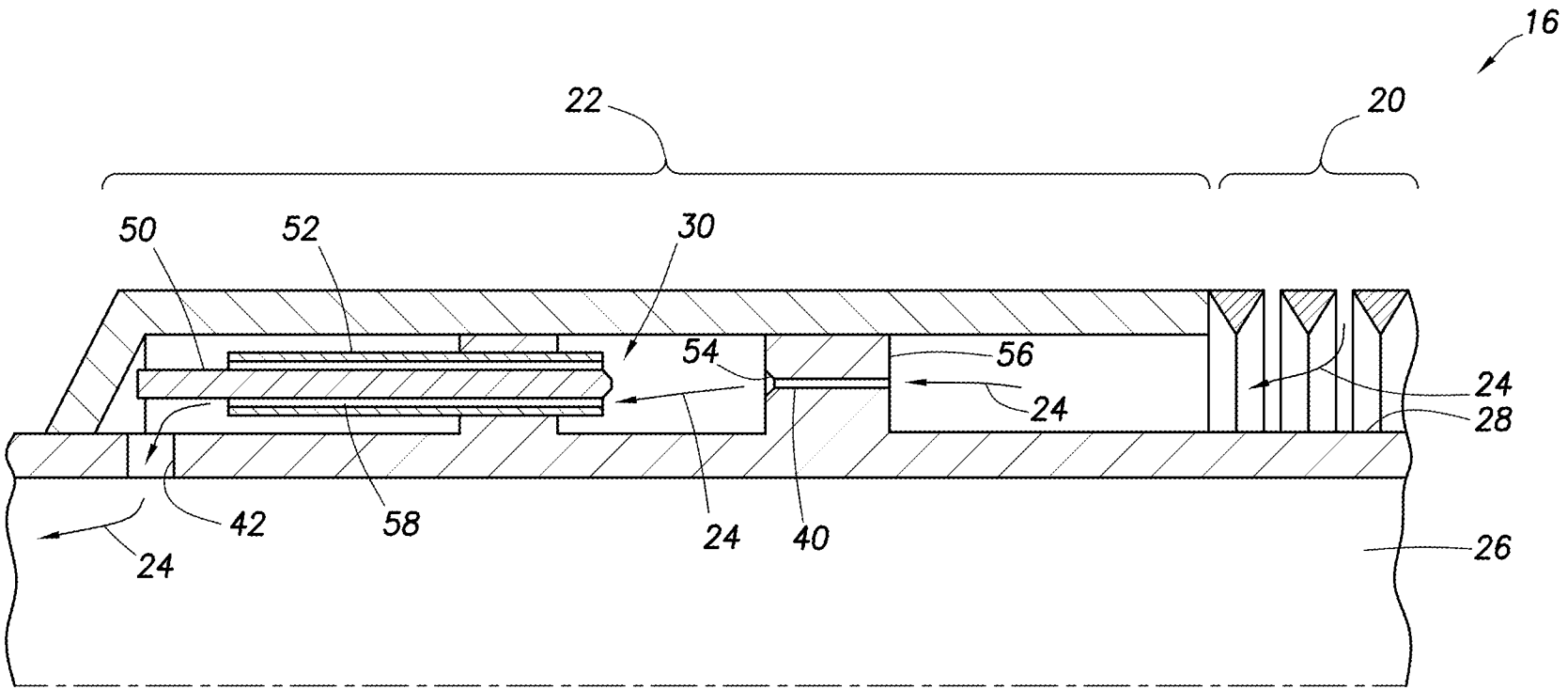
FIG. 2 is an enlarged scale schematic cross-sectional view through a screen assembly in the well system of FIG. 1, the screen assembly embodying principles of the invention.

Referring additionally now to FIG. 2, a schematic partially cross-sectional view of one of the well screen assemblies 16 is representatively illustrated at an enlarged scale. This screen assembly 16 is one of several different examples of screen assemblies described below in alternate configurations.

In this example, the screen assembly 16 includes a filter portion 20 and a flow control portion 22. The filter portion 20 is used to filter sand and/or other debris from fluid 24 which flows generally from an exterior to an interior of the screen assembly 16.

During production operations, the fluid 24 would typically flow from the wellbore 14 external to the screen assembly 16, through the filter portion 20 and flow control portion 22, and then into an internal flow passage 26 which extends longitudinally through the screen assembly as part of the tubular string 12. The fluid 24 can then be produced through the tubular string 12 to the surface.

However, it is not necessary for the fluid 24 to always flow inwardly through the filter portion 20 and/or the flow control portion 22. For example, at times during completion operations the fluid 24 may flow in the opposite direction. Some examples of screen assemblies which operate to prevent such reverse direction flow of the fluid 24, in order to prevent loss of the fluid into, or damage to, a formation surrounding the wellbore, are described below.

It is also not necessary for the fluid 24 to flow first through the filter portion 20 and then through the flow control portion 22. For example, the flow control portion 22 could be upstream of the filter portion 20, if desired.

The filter portion 20 is depicted in FIG. 2 as being of the type known as "wire-wrapped," since it is made up of a wire closely wrapped helically about a base pipe 28, with a spacing between the wire wraps being chosen to keep sand, etc. from passing between the wire wraps. Other types of filter portions (such as sintered, mesh, pre-packed, expandable, slotted, perforated, etc.) may be used, if desired.

The flow control portion 22 performs several functions. The flow control portion 22 is an ICD which functions to restrict flow therethrough, for example, to balance production of fluid along an interval. Furthermore, the flow control portion 22 functions to prevent fluid loss due to reverse flow of the fluid 24 from the passage 26 to the wellbore 14.

Several different constructions of the flow control device 30 are described below in various different configurations of the screen assembly 16. It should be understood that any of the flow control devices 30 described herein may be used in any of the screen assemblies described herein, without departing from the principles of the invention.

A flow restrictor 40 is connected upstream of the flow control device 30, so that the fluid 24 flows through the flow restrictor before flowing through the device and into the flow passage 26. Different arrangements of these elements may be used, if desired. For example, the flow restrictor 40 could be connected downstream of the flow control device 30.

In the example of FIG. 2, the flow restrictor 40 is an orifice or nozzle, but other types of flow restrictors may be used, if desired. For example, an annular passage, a helical tube or other type of flow restrictor could be used. The flow restrictor 40 could be in different positions, for example, an opening 42 in the base pipe 28 for admitting the fluid 24 into the passage 26 could be a flow restricting orifice.

The flow restrictor 40 is preferably used to balance production along an interval as discussed above. The resistance to flow through the flow restrictor 40 may be different for each of the screen assemblies 16 along an interval.

Although only one set of the flow control device 30 and flow restrictor 40 are depicted in FIG. 2 as part of the flow control portion 22, it should be understood that the flow control portion could include any number of flow control devices and any number of flow restrictors in keeping with the principles of the invention.

In this construction, the flow control device 30 includes a check valve in the form of a rod 50 reciprocably received within a generally tubular housing 52, and a seat 54 formed in a bulkhead 56 through which the fluid 24 flows during production operations.

The flow control device 30 in this configuration of the screen assembly 16 prevents loss of fluid into the formation surrounding the wellbore 14. As depicted in FIG. 2, the fluid 24 is flowing into the filter portion 20, and then through the flow control portion 22 into the flow passage 26 for production to the surface.

However, if the direction of flow should reverse (such as during completion operations, etc.), the drag on the rod 50 due to the fluid flowing through a small annulus 58 between the rod and the housing 52 will cause the rod to displace into engagement with the seat 54, thereby preventing this reverse flow of fluid from the flow passage 26 to the exterior of the screen assembly 16.

Due to sealing engagement between the rod 50 and the seat 54, as long as pressure in the flow passage 26 exceeds pressure external to the screen assembly 16, the flow control device 30 will remain closed. To commence production, pressure in the flow passage 26 can be reduced relative to pressure external to the screen assembly 16 (for example, by circulating lighter weight fluid into the tubular string 12, operating a pump, etc.) to thereby open the flow control device 30 by displacing the rod 50 away from the seat 54.

The rod 50 and housing 52 also function as a flow restrictor, in that a pressure drop will be generated as the fluid 24 flows through the annulus 58 between the rod and housing. This pressure drop is a function of the flow rate, annular area, density and viscosity of the fluid 24. Similarly, fluid loss from the tubular string 12 to the reservoir will produce a pressure drop through the annulus 58, thereby displacing the rod 50 into engagement with the seat 54. Thus, the pressure drop through the annulus 58 will hold the rod 50 away from the seat 54 and function as an ICD during production flow, and the pressure drop will cause the rod to engage the seat and prevent fluid loss in the event of reverse flow.

Figure 3:
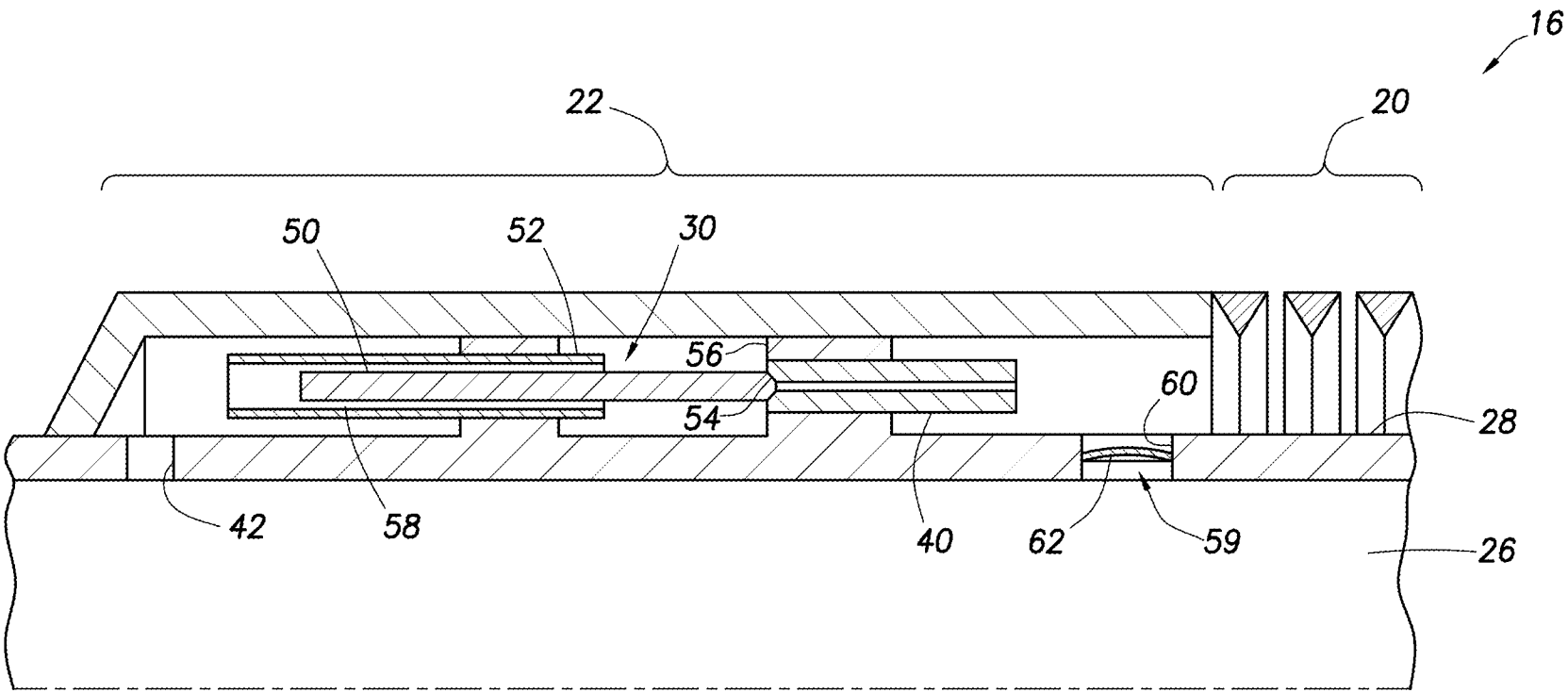
FIGS. 3-16 are schematic cross-sectional views of alternate constructions of the screen assembly embodying principles of the invention.

Referring additionally now to FIG. 3, another alternate construction of the screen assembly 16 is representatively illustrated. The screen assembly 16 includes the flow control portion 22 which functions as an ICD and also prevents fluid loss due to reverse flow of the fluid 24. The ICD has two flow restricting devices—the flow restrictor 40 and the annulus 58 between the rod 50 and the housing 52.

The screen assembly 16 of FIG. 3 is similar in many respects to the screen assembly of FIG. 2, in that the flow control device 30 includes the rod 50, housing 52 and seat 54 for preventing reverse flow and loss of fluid to the formation surrounding the wellbore 14. However, the screen assembly 16 of FIG. 3 also includes an alternate bypass flowpath 60 which can be opened if desired to bypass the flow control portion 22, or at least provide a decreased resistance to flow between the filter portion 20 and the flow passage 26.

If it is desired to open the bypass flowpath 60, pressure in the flow passage 26 may be increased relative to pressure external to the screen assembly 16 (for example, by applying increased pressure to the interior of the tubular string 12 from a remote location, etc.), in order to displace the rod 50 into engagement with the seat 54 (due to the pressure drop through the annulus 58) and burst a rupture disk 62. The flowpath 60 and rupture disk 62 thus comprise a flow resistance device 59 for decreasing a resistance to flow of the fluid 24 in response to a predetermined stimulus applied from a remote location.

It will be appreciated that, after the rupture disk 62 has been ruptured to open the flowpath 60, the resistance to flow between the filter portion 20 and the flow passage 26 will be substantially decreased as compared to the resistance to flow through the flow restrictor 40 and the annulus 58 between the rod 50 and the housing 52. Thus, the screen assembly 16 of FIG. 3 provides fluid loss prevention (for example, during completion operations, etc.), but also enables increased flow through the filter portion 20 when desired.

Figure 4:
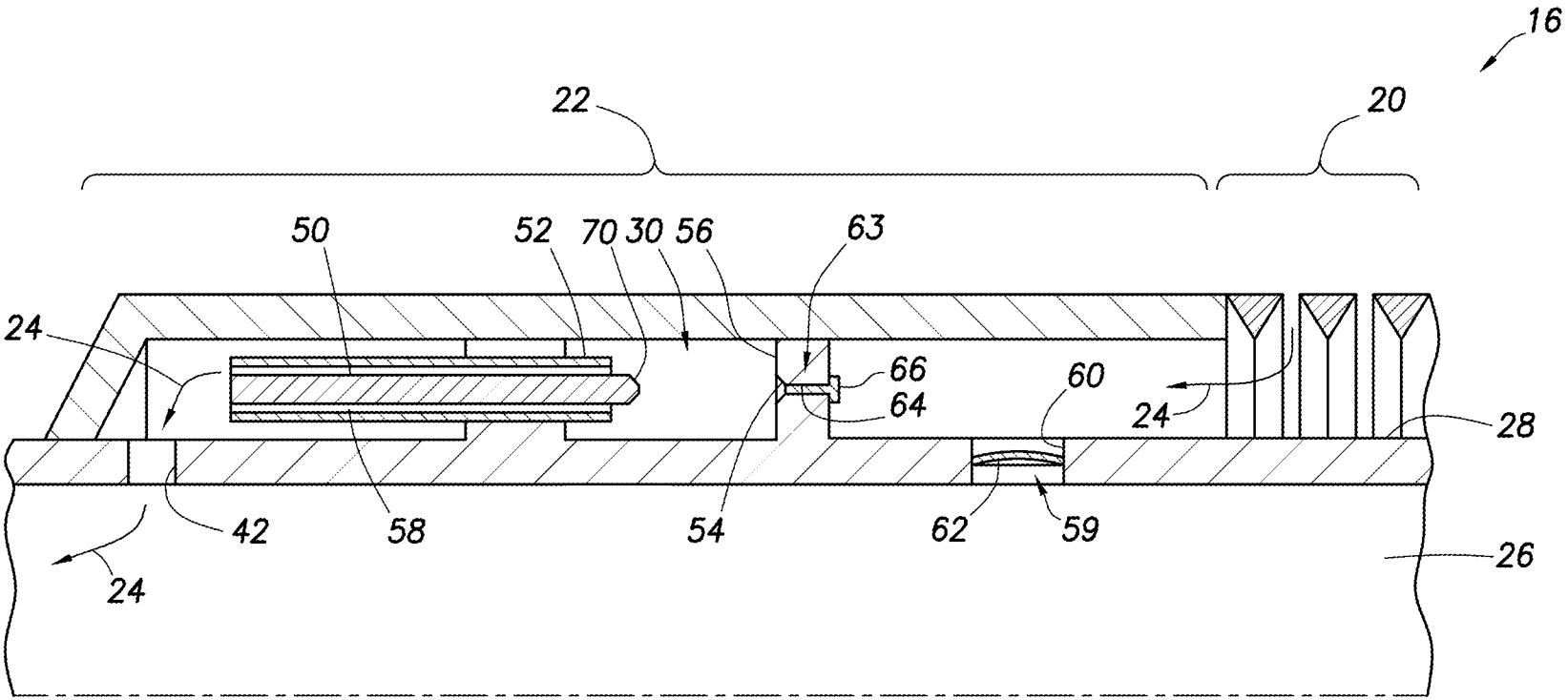

Referring additionally now to FIG. 4, another alternate construction of the screen assembly 16 is representatively illustrated. The screen assembly 16 includes the flow control portion 22 which functions as an ICD and also prevents reverse flow of the fluid 24. The ICD has two flow restricting devices—the flow restrictor 40 and the annulus 58 between the rod 50 and the housing 52.

In this embodiment of the screen assembly 16, the flow control device 30 is used in addition to at least one other flow restrictor 40 (not visible in FIG. 4) which provides for fluid communication between the filter portion 20 and the flow passage 26. For example, there could be one or more flow restrictors 40 provided in the bulkhead 56 as depicted in FIG. 3.

The flow control device 30 depicted in FIG. 4 permits a restriction to the flow of the fluid 24 to be decreased when desired, by opening one or more bypass flowpaths 64 which are initially blocked by respective one or more plugs 66. This result is accomplished by increasing pressure in the flow passage 26 relative to pressure on the exterior of the screen assembly 16, to thereby cause the rod 50 to displace toward the seat 54 adjacent the flow restrictor 40 (see FIG. 3).

Once the rod 50 has engaged the seat 54 adjacent the flow restrictor 40, a pressure differential across the plug 66 will cause the plug to dislodge from the flowpath 64. A sealing surface 70 on the rod 50 will then engage the seat 54 to close off the bypass flowpath 64, so that any other flow control devices 30 included in the flow control portion 22 can be similarly operated to open additional bypass flowpaths. The flowpath 64 and plug 66 comprise a flow resistance device 63 for decreasing a resistance to flow of the fluid 24 in response to a predetermined stimulus applied from a remote location.

Thus, when pressure in the flow passage 26 is increased, those rods 50 which are associated with flow restrictors 40 will displace into engagement with the seats 54 adjacent the flow restrictors 40, thereby enabling a pressure differential to be applied across the plugs 66. As each plug 66 is dislodged from its respective flowpath 64, the associated rod 50 will displace into engagement with its seat to close off the flowpath. This process will occur in each screen assembly 16 along the tubular string 12.

Production can be resumed by reducing the pressure in the flow passage 26 relative to pressure external to the screen assembly 16 to thereby displace the rods 50 away from the seats 54 and allow flow of the fluid 24 through the bypass flowpaths 64. It will be appreciated that, by opening one or more of the bypass flowpaths 64 in the flow control portion 22, restriction to flow of the fluid 24 through the flow control portion 22 can be substantially decreased.

If further reduction in the restriction to flow of the fluid 24 is desired, the bypass flowpath 60 and rupture disk 62 can be provided, as in the embodiment of FIG. 3.

Figure 5:
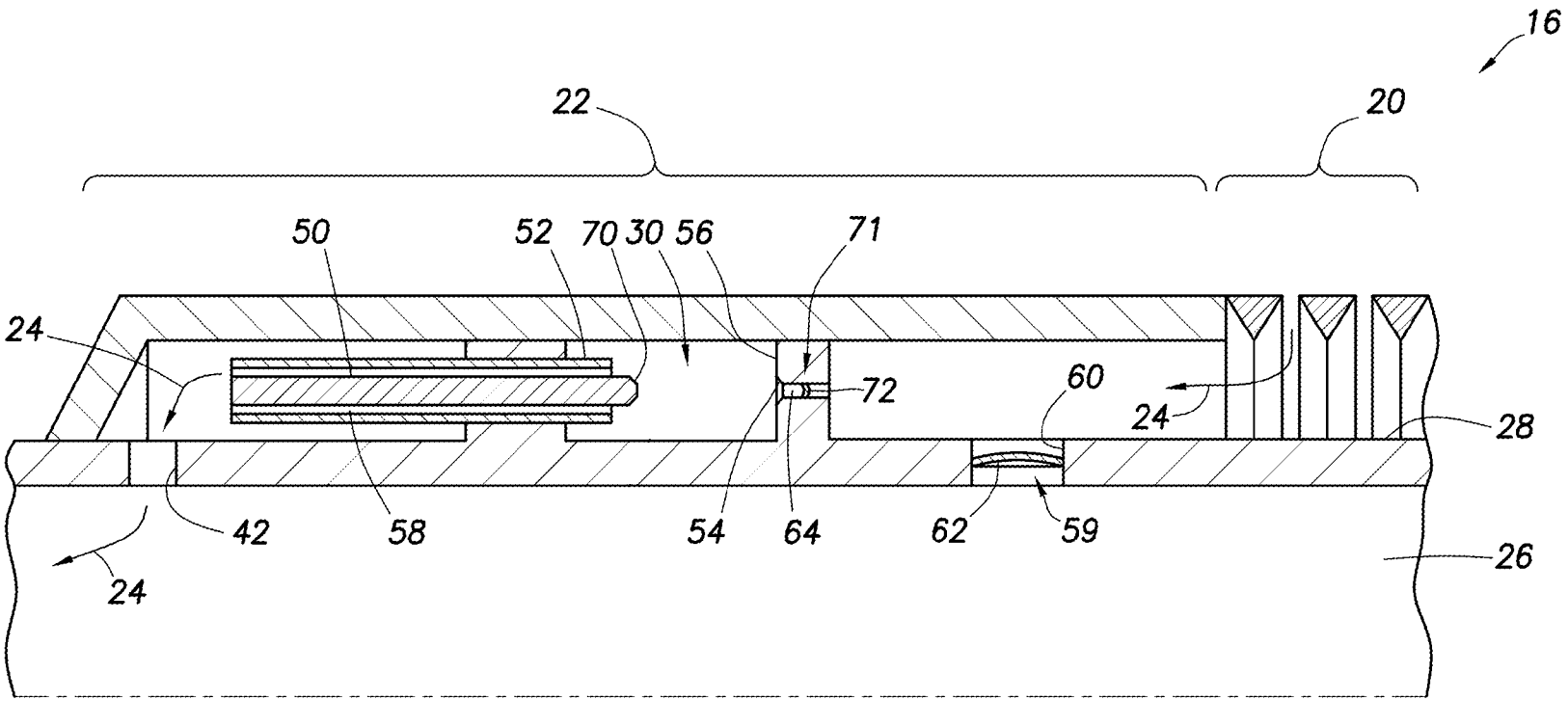

Referring additionally now to FIG. 5, another alternate construction of the screen assembly 16 is representatively illustrated. The screen assembly 16 includes the flow control portion 22 which functions as an ICD and also prevents reverse flow of the fluid 24. The ICD has two flow restricting devices—the flow restrictor 40 and the annulus 58 between the rod 50 and the housing 52.

This example functions almost the same way as the embodiment of FIG. 4, except that instead of the plug 66, a rupture disk 72 initially blocks flow of the fluid 24 through the bypass flowpath 64. The rupture disk 72 may be ruptured due to an increase in pressure differential from the flow passage 26 to the exterior of the screen assembly 16.

The flow control device 30 is used in addition to at least one other flow restrictor 40 (not visible in FIG. 5) which provides for fluid communication between the filter portion 20 and the flow passage 26. For example, there could be one or more flow restrictors 40 provided in the bulkhead 56 as depicted in FIG. 3.

The flow control device 30 depicted in FIG. 5 permits a restriction to the flow of the fluid 24 to be decreased when desired, by opening one or more bypass flowpaths 64 which are initially blocked by respective one or more rupture disks 72. This result is accomplished by increasing pressure in the flow passage 26 relative to pressure on the exterior of the screen assembly 16, to thereby cause the rod 50 to displace toward the seat 54 adjacent the flow restrictor 40 (see FIG. 3).

Once the rod 50 has engaged the seat 54 adjacent the flow restrictor 40, a pressure differential across the rupture disk 72 will cause the disk to rupture and open the flowpath 64. A sealing surface 70 on the rod 50 will also eventually engage the seat 54 to close off the bypass flowpath 64, so that any other flow control devices 30 included in the flow control portion 22 can be similarly operated to open additional bypass flowpaths.

Thus, when pressure in the flow passage 26 is increased, those rods 50 which are associated with flow restrictors 40 will displace into engagement with the seats 54 adjacent the flow restrictors 40, thereby enabling a pressure differential to be applied across the rupture disks 72. As each disk 66 is ruptured, the associated rod 50 will displace into engagement with its seat to close off the flowpath. This process will occur in each screen assembly 16 along the tubular string 12.

After the disks 72 are ruptured or otherwise opened, the sealing surface 70 will engage the seat 54, and the remainder of the operation of the screen assembly is the same as described above for the FIG. 3 embodiment. The flowpath 64 and rupture disk 72 thus comprise a flow resistance device 71 for decreasing a resistance to flow of the fluid 24 in response to a predetermined stimulus applied from a remote location.

Figure 6:
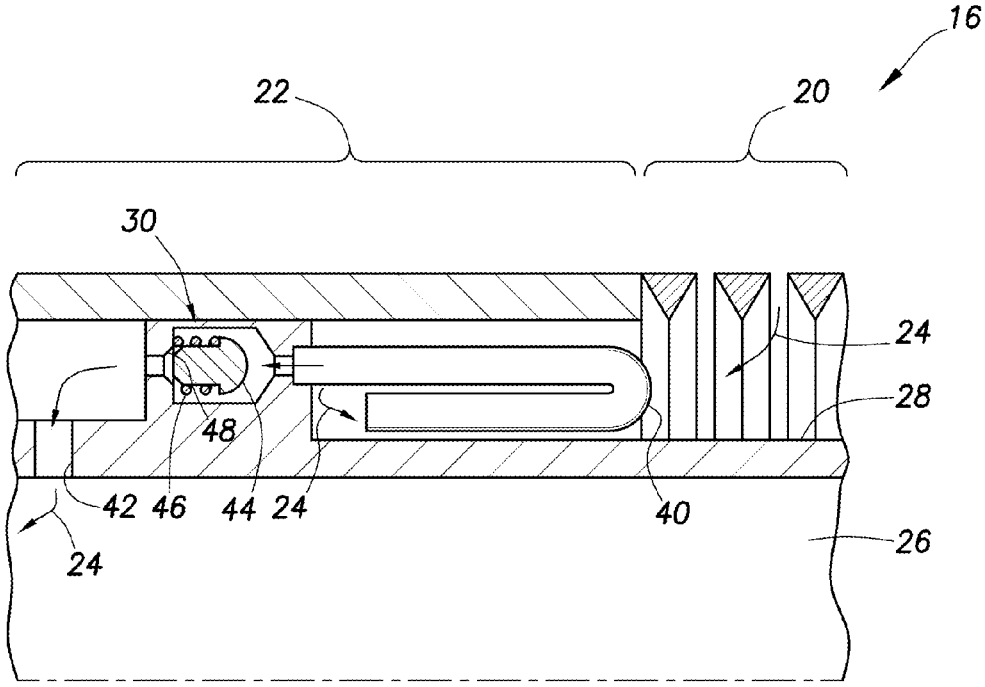

Referring additionally now to FIG. 6, an alternate construction of the screen assembly 16 is representatively illustrated. The screen assembly 16 of FIG. 6 includes the flow control portion 22 which functions as an ICD and also reduces production of undesired fluids. The ICD includes the flow restrictor 40.

The flow restrictor 40 as depicted in FIG. 6 is a bent tubular structure which forces the fluid 24 to change direction as it enters and flows through the flow restrictor. This repeated change in momentum of the fluid 24 increases the resistance to flow through the flow restrictor 40 without requiring use of narrow flow passages which would more easily become clogged.

A pressure drop through the flow restrictor 40 will increase as the length of the tube increases, and as the number of bends in the tube increases. A viscous fluid such as oil will flow much slower through the tube as compared to water.

The flow control device 30 depicted in FIG. 6 is of the type known to those skilled in the art as a velocity check valve. It includes a poppet 44, a biasing device 46 and a seat 48. The biasing device 46 applies a force to the poppet 44 in a direction away from the seat 48.

The flow control device 30 of FIG. 6 is responsive to a flow rate and velocity of the fluid 24, and since the velocity of the fluid is related to its density, the flow control device is also responsive to the density of the fluid.

As the velocity of the fluid 24 increases, the drag force on the poppet 44 gradually overcomes the biasing force exerted by the biasing device 46, and the poppet displaces more toward the seat 48, thereby reducing the flow area through the flow control device 30. When the velocity of the fluid 24 is great enough, the poppet 44 will engage the seat 48, thereby closing the flow control device 30 and preventing flow of the fluid 24 through the flow control device.

As long as pressure external to the screen assembly 16 exerted via the filter portion 20 is sufficiently greater than pressure in the interior flow passage 26 (as would be the case in typical production operations), the flow control device 30 will remain closed. This will exclude higher density fluid (such as water) from being produced through the screen assembly 16.

If it is later desired to restart production through the screen assembly 16, then pressure in the interior flow passage 26 may be increased relative to pressure external to the screen assembly (for example, by shutting in the tubular string 12 downstream of the screen assembly to equalize the pressures, or by applying increased pressure to the flow passage 26, etc.). In this manner, the poppet 44 can be displaced away from the seat 48, and the flow control device 30 will again be open for permitting flow of the fluid 24. It is a particular advantage of this configuration of the screen assembly 16 that it can be "reset" in this manner when desired.

Figure 7:
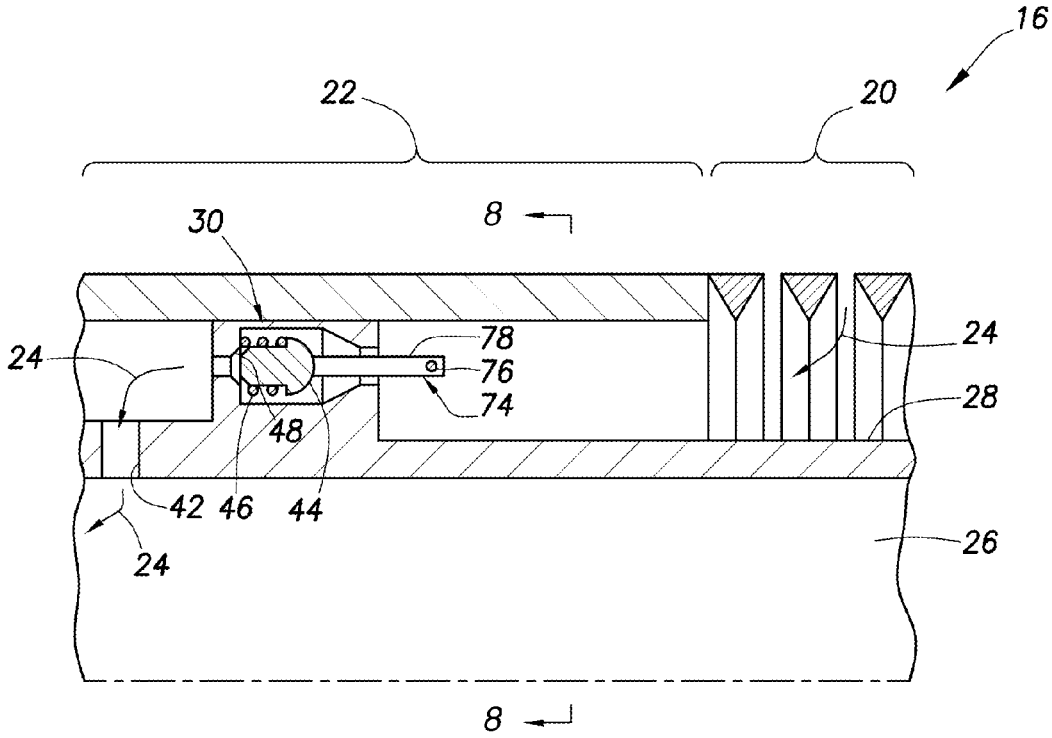
Figure 8:
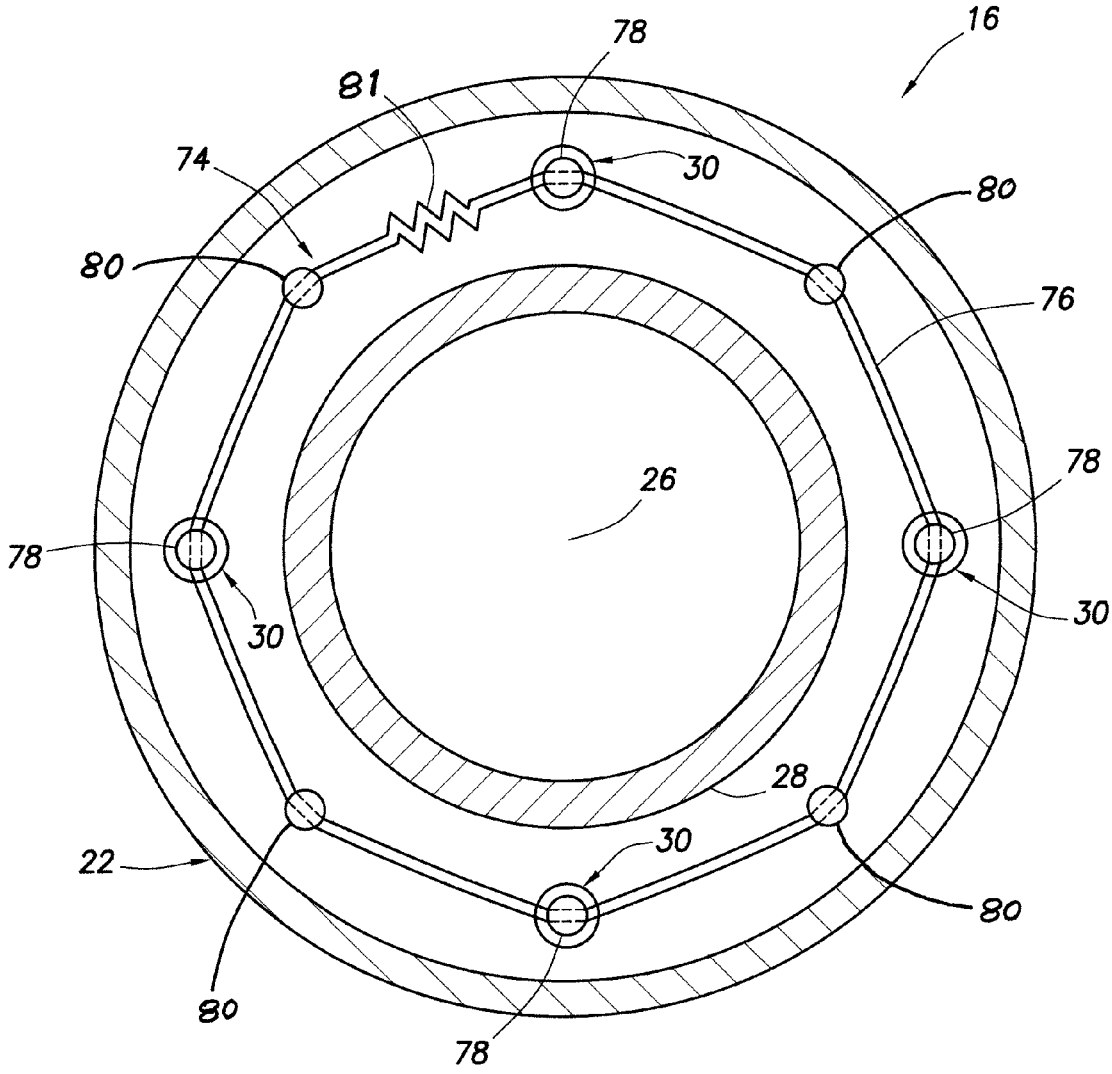

Referring additionally now to FIGS. 7 & 8, another alternate construction of the screen assembly 16 is representatively illustrated. The screen assembly 16 of FIGS. 7 & 8 includes the flow control portion 22 which functions as an ICD and also reduces production of undesired fluids.

This example is similar in many respects to the embodiment of FIG. 6, except that the FIGS. 7 & 8 embodiment includes an inhibitor device 74 which progressively varies a response of multiple flow control devices 30 as more of the flow control devices respond to the change in velocity of the fluid 24.

The flow control devices 30 include the poppet 44, biasing device 46 and seat 48 of the FIG. 6 embodiment, so that the flow control devices function as velocity check valves to close off flow of the fluid 24 when the flow rate or velocity of the fluid increases. The inhibitor device 74 progressively inhibits the flow control devices 30 from closing as an increasing number of the flow control devices close.

The inhibitor device 74 includes a flexible cable 76 which passes through extensions 78 of the poppets 44. In FIG. 8 it may be seen that the cable 76 extends around to each of the extensions 78, and also passes through rigid posts 80 positioned between the flow control devices 30.

When the velocity of the fluid 24 flowing through one of the flow control devices 30 increases sufficiently, the flow control device will close (i.e., the poppet 44 will engage the seat 48). As a result, the corresponding extension 78 will displace with the poppet 44, thereby applying an increased tensile force to the cable 76.

This increased force transmitted to the cable 76 will inhibit the next flow control device 30 from closing. However, when the velocity of the fluid 24 flowing through this next flow control device 30 does increase sufficiently to overcome the increased force in the cable 76, it too will close and thereby apply a further increased tensile force to the cable 76.

Thus, it will be appreciated that, as each flow control device 30 closes, the inhibitor device 74 increasingly inhibits the next flow control device from closing. A biasing device 81, such as a spring, may be interconnected in the cable 76 to supply an initial force in the cable 76, and to provide resilience. The biasing device 81 may be conveniently designed to regulate the amount by which each successive flow control device 30 is progressively inhibited from closing.

It is contemplated that, if the fluid 24 is stratified into layers of oil and water in the flow control portion 22, the flow control device 30 having the greatest proportion of water flowing through it will close first (due to the reduced viscosity of the water resulting in an increased velocity of flow of the water through that flow control device). This will reduce the production of water through the screen assembly 16, while still allowing production of oil through the screen assembly.

Subsequent flow control devices 30 will close when further increased velocities of flow of the fluid 24 through the flow control devices are experienced. This helps to keep one or more of the flow control devices 30 open until the fluid 24 includes a substantial proportion of water, while still allowing the first few flow control devices to close when the fluid includes only a small proportion of water.

One beneficial feature of this embodiment is that the inhibitor device 74 works in this manner to exclude production of the higher density, lower viscosity proportion of the fluid 24 without regard to a certain azimuthal orientation of the flow control portion 22. Thus, the screen assembly 16 does not have to be installed in any particular orientation to achieve the benefits described above.

Figure 9:
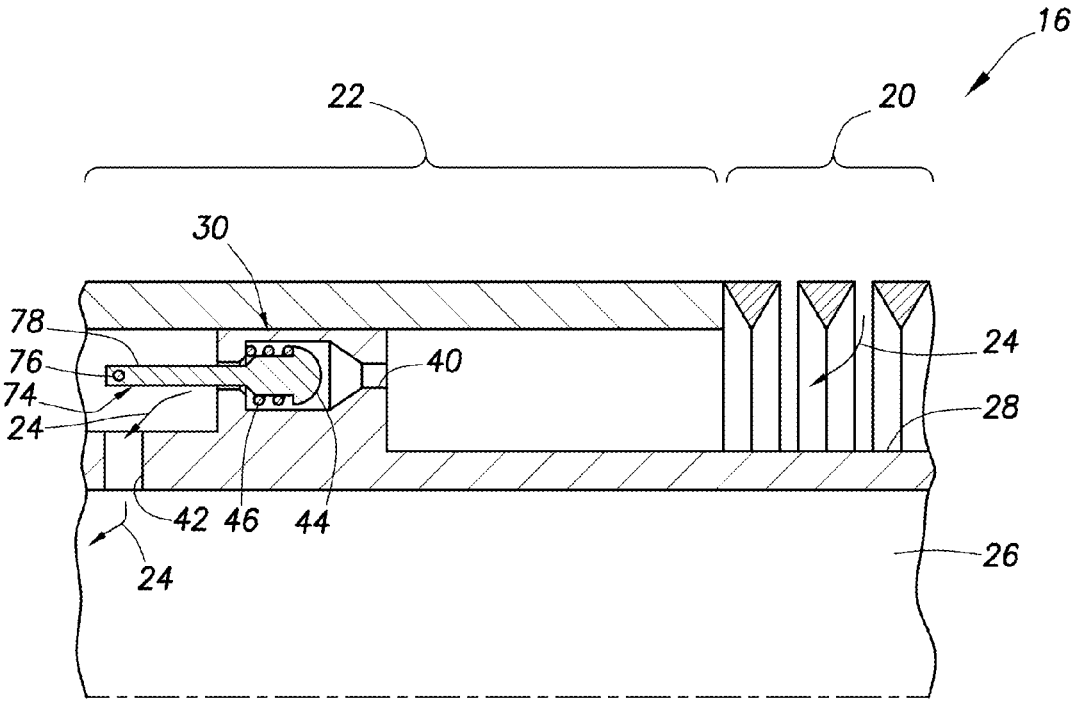

Referring additionally now to FIG. 9, another alternate construction of the screen assembly 16 is representatively illustrated. The screen assembly 16 of FIG. 9 includes the flow control portion 22 which functions as an ICD and also reduces production of undesired fluids. The ICD includes the flow restrictor 40.

This example is very similar to the embodiments of FIGS. 7 & 8, except that the inhibitor device 74 is positioned on an opposite side of the flow control device 30. Thus, the poppet 44 in the embodiment of FIG. 9 "pushes" on the cable 76 via the extension 78, instead of "pulling" on the cable as in the embodiment of FIGS. 7 & 8.

Figure 10:
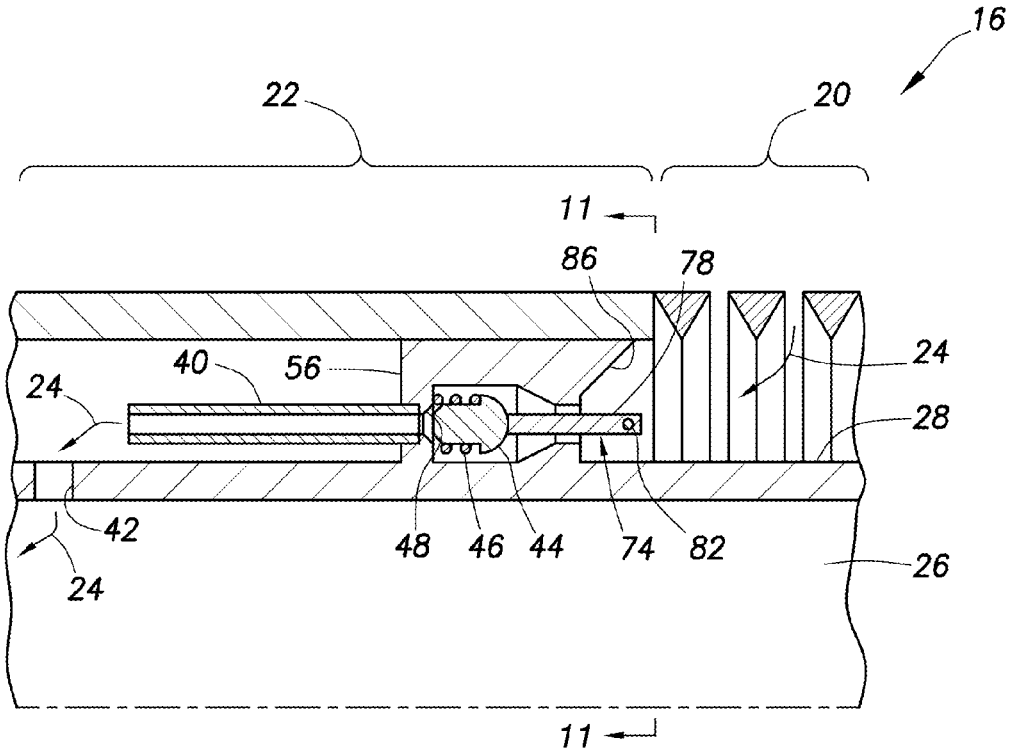
Figure 11:
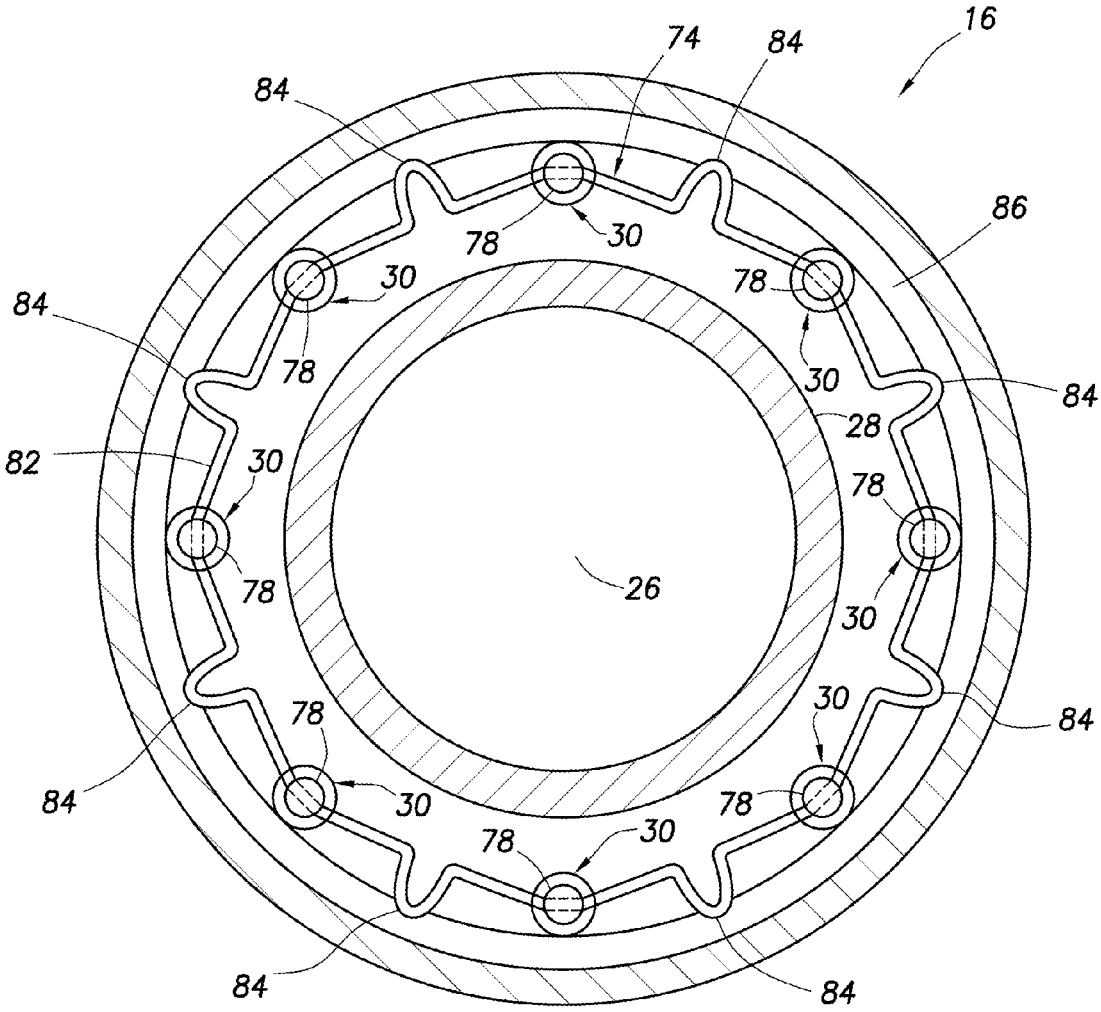

Referring additionally now to FIGS. 10 & 11, another alternate construction of the screen assembly 16 is representatively illustrated. The screen assembly 16 of FIGS. 10 & 11 includes the flow control portion 22 which functions as an ICD and also reduces production of undesired fluids. The ICD includes the flow restrictor 40.

This example of the screen assembly 16 is similar in many respects to the embodiment of FIGS. 7 & 8, except that instead of the cable 76, the embodiment of FIGS. 10 & 11 includes a relatively stiff wire flow wire 82 extends through each extension 78 of the flow control devices 30, but no posts 80 are used. Instead, the wire 82 has ears 84 formed thereon which engage an inclined surface 86 formed on the bulkhead 56.

This engagement between the ears 84 of the wire 82 and the inclined surface 86 resists displacement of the poppets 44 toward their respective seats 48. Eight flow control devices 30, with an ear 84 positioned between each adjacent pair of flow control devices, are depicted in FIG. 11, but it should be understood that any number of these elements may be used in keeping with the principles of the invention.

Figure 12:
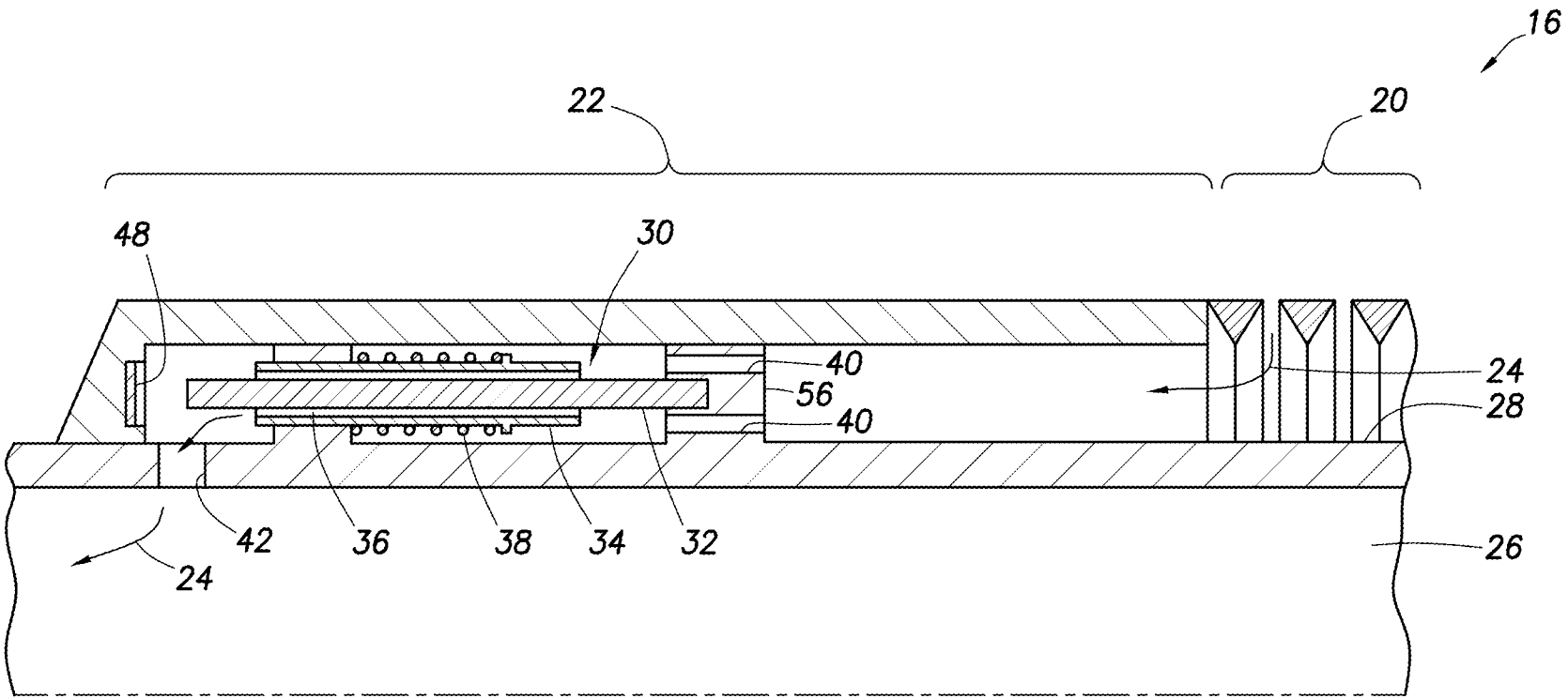

Referring additionally now to FIG. 12, another alternate construction of the screen assembly 16 is representatively illustrated. The screen assembly 16 of FIG. 12 includes the flow control portion 22 which functions as an ICD and also reduces production of undesired fluids. The ICD includes flow restrictors 40 and an annular flowpath 36 between a rod 32 and housing 34.

This example of the screen assembly 16 functions somewhat the same as the FIG. 6 embodiment, but demonstrates that similar functionality can be achieved by different configurations in keeping with the principles of the invention.

The FIG. 12 embodiment includes the rod 32, housing 34 and biasing device 38, but in this embodiment the rod is rigidly attached to the bulkhead 56 and the housing is reciprocably disposed on the rod. As the flow rate or velocity of the fluid 24 increases (e.g., due to decreased viscosity of the fluid)

a drag force produced as the fluid flows through the annular flowpath 36 increases and displaces the housing 34 toward the seat 48, against the biasing force exerted by the biasing device 38.

Eventually, the housing 34 engages the seat 48 and shuts off flow of the fluid 24 into the flow passage 26. In this manner, the flow control device 30 operates as a velocity check valve to eventually reduce the flow area through the flow control device to zero as the velocity of the fluid 24 increases.

Figure 13:
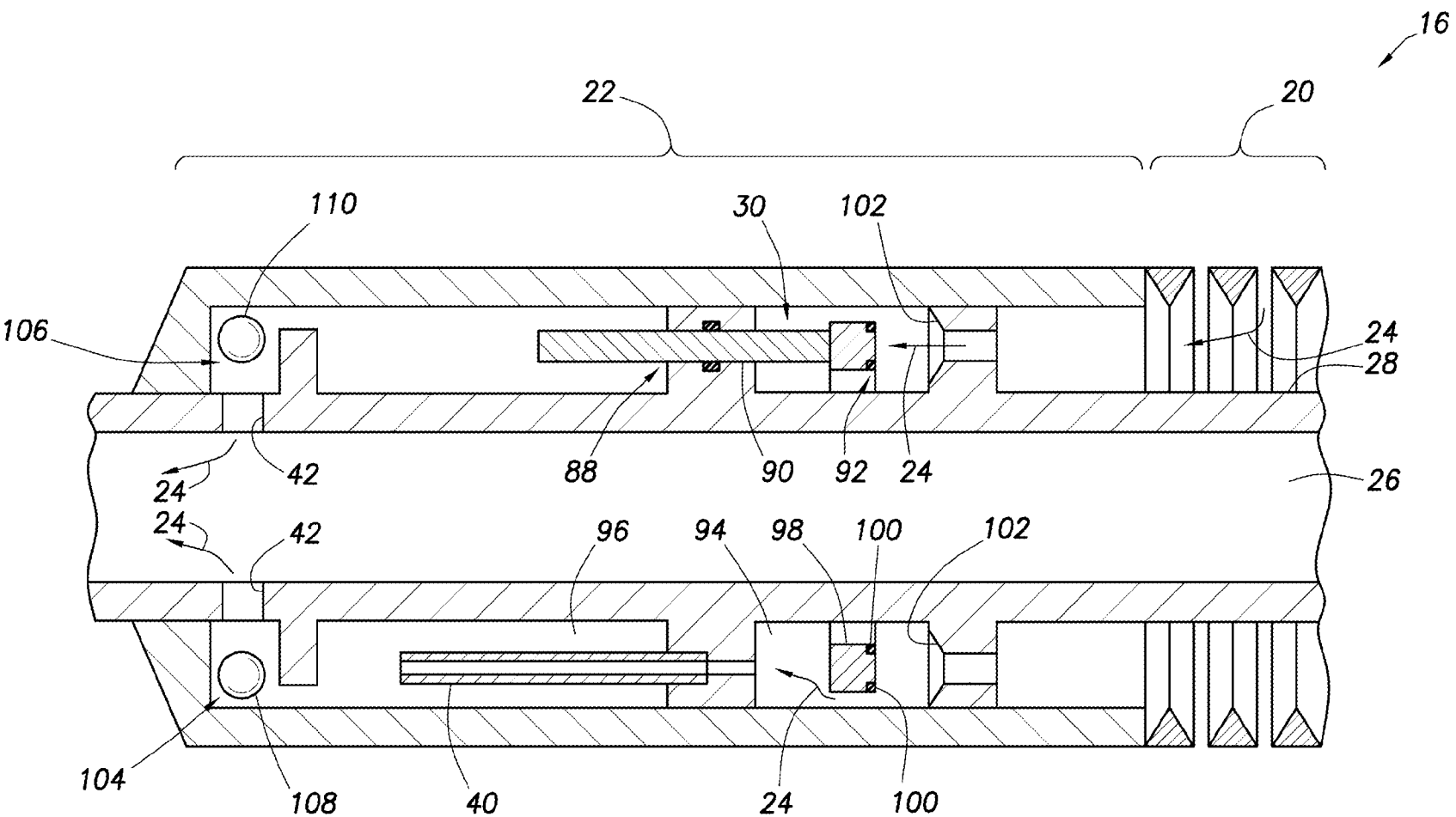

Referring additionally now to FIG. 13, another alternate construction of the screen assembly 16 is representatively illustrated. The screen assembly 16 of FIG. 13 includes the flow control portion 22 which functions as an ICD, prevents fluid loss from the tubular string 12 and also reduces production of undesired fluids. The ICD includes the flow restrictor 40, which could be a tube, orifice, nozzle or coiled tube. The openings 42 could also serve as flow restrictors if so designed.

This example of the screen assembly 16 is similar in some respects to those embodiments described above (e.g., the embodiments of FIGS. 2 & 3) which prevent reverse flow of fluid through the screen assembly. However, the flow control device 30 of the FIG. 13 embodiment includes a hydraulic actuator 88 for selectively opening and closing a valve 92 to thereby control flow of fluid and prevent loss of fluid. The actuator 88 includes a piston 90 which displaces in response to a pressure differential between internal chambers 94, 96. The valve 92 includes a closure 98 with sealing surfaces 100 for sealingly engaging seats 102.

When pressure in the chamber 94 sufficiently exceeds pressure in the chamber 96 (due to a pressure drop through the flow restrictor 40), the piston 90 will displace in a direction pulling the closure 98 and sealing surfaces 100 away from the seats 102, thereby permitting flow of the fluid 24 through the flow control portion 22. However, if pressure in the chamber 96 sufficiently exceeds pressure in the chamber 94 (as would be the case typically in a reverse flow condition), the piston 90 will exert a biasing force to displace the closure 98 and sealing surfaces 100 into engagement with the seats 102 to thereby shut off the flow.

The flow control device 30 may be "reset" to again permit flow by reducing pressure in the flow passage 26 relative to pressure on the exterior of the screen assembly 16, thereby increasing the pressure differential from the chamber 94 to the chamber 96. This will cause the piston 90 to exert a biasing force on the closure 98 and displace the closure away from the seats 102, thereby opening the flow control portion 22 to flow of the fluid 24.

The flow control portion 22 of the FIG. 13 embodiment also includes a water excluder device 104 and a gas excluder device 106. The water excluder device 104 preferably includes multiple spherical bodies 108 which are neutrally buoyant in water, so that when water is produced through the flow control portion 22, the bodies float in the water and engage the openings 42 to close off the openings and thereby exclude production of the water. As the fluid 24 includes a greater proportion of water, progressively more of the openings 42 are closed off.

The gas excluder device 106 preferably includes multiple spherical bodies 110 which are less dense than oil, so that when gas is produced through the filter portion 22, the bodies float on top of the oil and engage the openings 42 to close off the openings and thereby exclude production of the gas. As the fluid 24 contains a greater proportion of gas, progressively more of the openings 42 are closed off.

The water and gas excluder devices 104, 106 may be similar to any of those described in U.S. Pat. No. 7,185,706 and application Ser. Nos. 11/671,319 filed Feb. 5, 2007 and 11/466,022 filed Aug. 21, 2006. The entire disclosures of this patent and these applications are incorporated herein by this reference. Of course, other types of water and/or gas excluder devices may be used in keeping with the principles of the invention.

Figure 14:
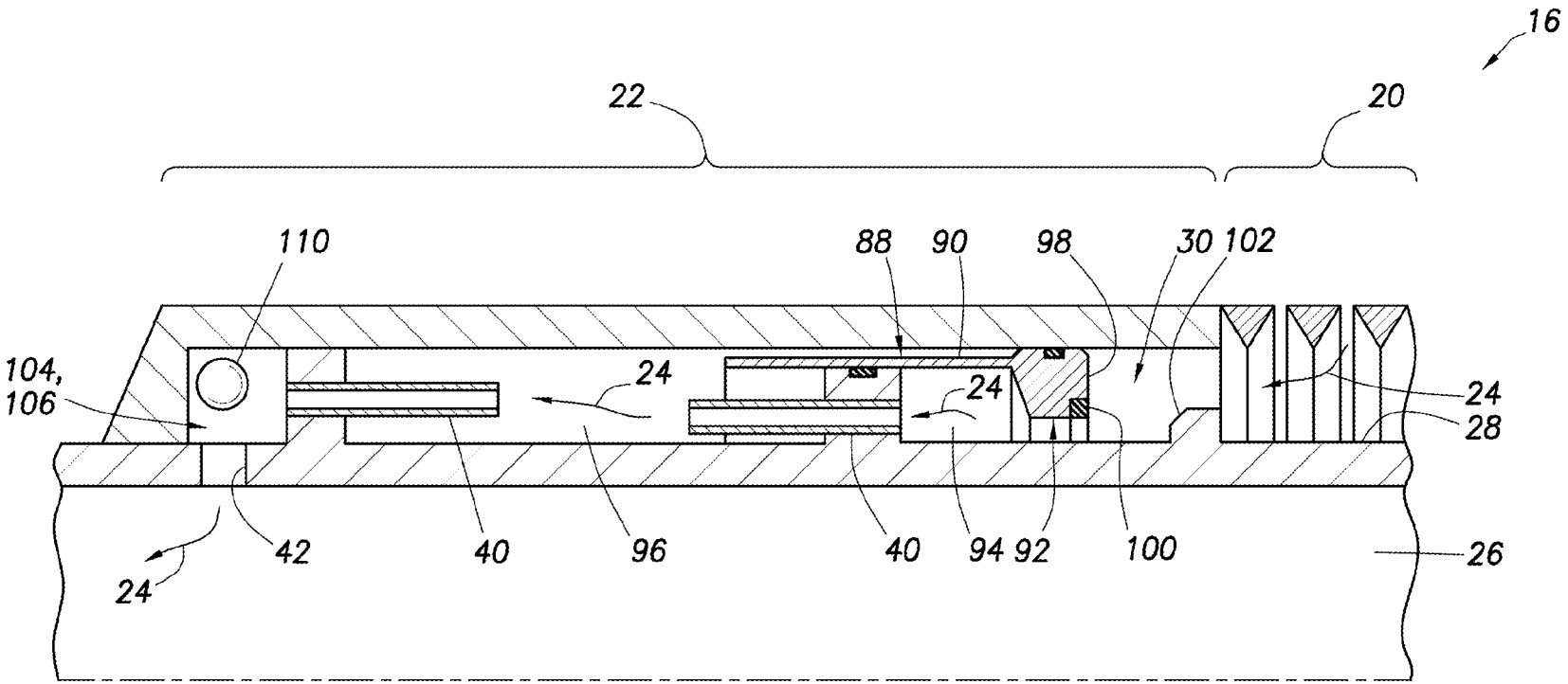

Referring additionally now to FIG. 14, another alternate construction of the screen assembly 16 is representatively illustrated. The screen assembly 16 includes the flow control portion 22 which functions as an ICD, prevents fluid loss from the tubular string 12 and also reduces production of undesired fluids. The ICD has two flow restrictors 40.

This example of the screen assembly 16 is similar in many respects to the embodiment of FIG. 13, except that the actuator 88 and valve 92 are somewhat differently configured. In the embodiment of FIG. 14, a much larger flow area through the valve 92 is provided, and the piston 90 of the actuator 88 has a larger differential piston area. In addition, only one each of the sealing surface 100 and seat 102 are used in the valve 92.

Figure 15:
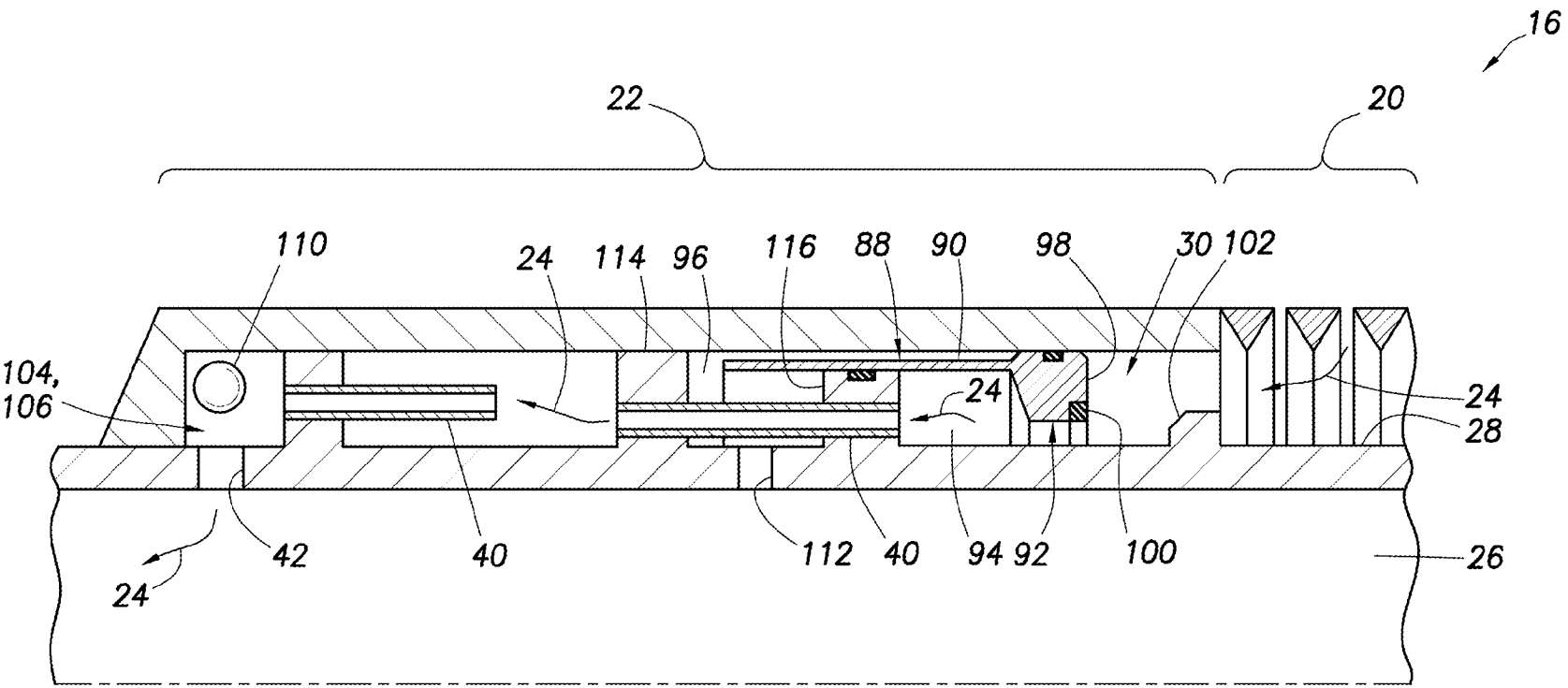

Referring additionally now to FIG. 15, another alternate construction of the screen assembly 16 is representatively illustrated. This example of the screen assembly 16 is similar in many respects to the embodiment of FIG. 14, except that the actuator chamber 96 is directly exposed to pressure in the interior flow passage 26 via an opening 112.

The chamber 96 is formed between two bulkheads 114, 116, with the opening 112 providing direct communication between the chamber and the flow passage 26. Thus, the actuator 88 is more directly responsive to the pressure differential between the flow passage 26 and the exterior of the screen assembly 16 as compared to the embodiments of FIGS. 13 & 14.

Figure 16:
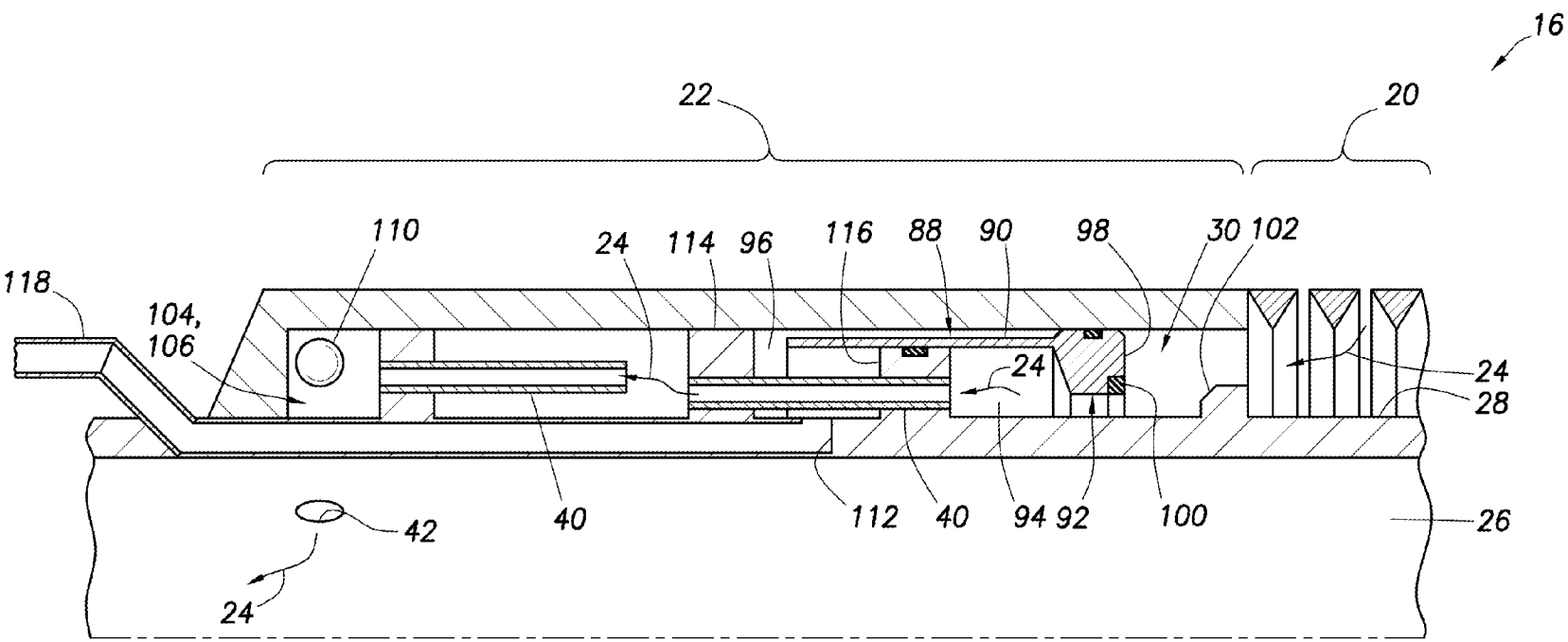

Referring additionally now to FIG. 16, another alternate construction of the screen assembly 16 is representatively illustrated. This example of the screen assembly 16 is similar in many respects to the embodiment of FIG. 15, except that the actuator chamber 96 is not exposed to pressure in the interior flow passage 26, but is instead exposed to pressure in a line 118 extending to a remote location.

Thus, pressure delivered via the line 118 may be used to regulate the operation of the valve 92 by varying the pressure differential between the chambers 94, 96. Specifically, the valve 92 may be closed by applying increased pressure to the line 118, thereby causing the actuator 88 to displace the piston 98 and close the valve 92. Reduced pressure may be applied via the line 118 to open the valve 92.

The line 118 may be of the type known to those skilled in the art as a control line, and the line may be positioned internal, external or within a sidewall of the tubular string 12. The line 118 may extend to the surface, or to another remote location in the well, such as to a pump or control module. In this manner, the flow control device 30 may be operated remotely to control flow of the fluid 24 through the screen assembly 16.

It may now be fully appreciated that the foregoing detailed description provides many advancements in the art. For example, the present specification provides a well screen assembly 16 which includes a filter portion 20 for filtering fluid 24, and a flow control device 30 which varies a resistance to flow of the fluid 24 in response to a change in velocity of the fluid.

The flow control device 30 may include a velocity check valve (such as in the embodiments of FIGS. 6 & 12). The flow control device 30 may decrease a flow area in response to an increase in the velocity of the fluid 24.

The flow control device 30 may increase the resistance to flow in response to an increase in density of the fluid 24 (such as in the embodiments of FIGS. 7-11). The flow control device 30 may increase the resistance to flow in response to an increase in velocity of the fluid 24.

The well screen assembly 16 may include one or more flow restrictors 40 interconnected upstream and/or downstream of the flow control device 30.

The well screen assembly 16 may include multiple flow control devices 30, and an inhibitor device 74 which progressively varies a response of the flow control devices as more of the flow control devices respond to the change in velocity of the fluid 24. The inhibitor device 74 may progressively inhibit the flow control devices 30 from closing as an increasing number of the flow control devices close.

Also provided are the well screen assembly 16 embodiments which include a flow resistance device 59, 63 and/or 71 which decreases a resistance to flow of the fluid 24 in response to a predetermined stimulus applied from a remote location. The stimulus may comprise a pressure variation. The pressure variation may comprise an increase in a pressure differential from an interior to an exterior of the well screen assembly 16.

The flow resistance device 59, 63, 71 may comprise a flowpath 60, 64 which opens in response to the stimulus. The flowpath 60, 64 may bypass a flow restrictor 40 which restricts flow of the fluid 24. The flow resistance device 63 may include a plug 66 which displaces to unblock the flowpath 64 in response to the stimulus. The flow resistance device 63, 71 may include a check valve which closes the flowpath 64 in response to the stimulus, and which opens the flowpath in response to release of the stimulus.

Also provided are the well screen assembly 16 embodiments which comprise a valve 92 including an actuator 88 having a piston 90 which displaces in response to a pressure differential to thereby selectively permit and prevent flow of the fluid 24 through the valve 92. The well screen assembly 16 may also include a flow restrictor 40 which restricts flow of the fluid 24.

The pressure differential may be between chambers 94, 96 on respective upstream and downstream sides of the flow restrictor 40. The pressure differential may be between an inner flow passage 26 extending longitudinally through the well screen assembly 16 and an internal chamber 94 of the well screen assembly 16 in selective fluid communication with the filter portion 20. The internal chamber 94 may be upstream of a flow restrictor 40 which restricts flow of the fluid 24. The pressure differential may be between a line 118 extending to a remote location and an internal chamber 94 of the well screen assembly 16 in selective fluid communication with the filter portion 20.

The well screen assembly 16 may include a water excluder device 104 which increasingly restricts flow of the fluid 24 as a proportion of water in the fluid increases. The well screen assembly 16 may include a gas excluder device 106 which increasingly restricts flow of the fluid 24 as a proportion of gas in the fluid increases. The well screen assembly 16 may include any excluder device 104, 106 which increasingly blocks flow of an undesired portion of the fluid 24 as the undesired portion increases, and a flow restrictor 40 which restricts flow of the fluid 24.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A well screen assembly, comprising:

a base pipe;

a filter portion which filters a fluid prior to the fluid entering the base pipe; and a flow control portion which selectively decreases a resistance to flow of the fluid through the well screen assembly into the base pipe in a first direction in response to a predetermined stimulus applied from a remote location, and which prevents outward fluid flow through the well screen assembly in response to flow of the fluid in a second direction opposite from the first direction, wherein the stimulus comprises an increase in a pressure within the base pipe.

2. The well screen assembly of claim 1, wherein the flow control portion comprises a flowpath which opens in response to the stimulus.

3. The well screen assembly of claim 2, wherein the flowpath bypasses a flow restrictor which restricts flow of the fluid.

4. The well screen assembly of claim 2, wherein the flow control portion further comprises a plug which displaces to unblock the flowpath in response to the stimulus.

5. The well screen assembly of claim 2, wherein the flow control portion further comprises a check valve which closes the flowpath in response to the stimulus, and which opens the flowpath in response to release of the stimulus.

* * * * *